US010274295B2

(12) United States Patent
Peelgrane et al.

(10) Patent No.: US 10,274,295 B2
(45) Date of Patent: Apr. 30, 2019

(54) ARTILLERY GRENADE HOLSTER

(71) Applicant: RE FACTOR TACTICAL, LLC, Commerce City, CO (US)

(72) Inventors: Luke Quinn Peelgrane, Commerce City, CO (US); Adam C. Main, Lilburn, GA (US)

(73) Assignee: RE FACTOR TACTICAL LLC, Denver, CO (US)

( * ) Notice: Subject to any disclaimer, the term of this patent is extended or adjusted under 35 U.S.C. 154(b) by 617 days.

(21) Appl. No.: 14/879,025

(22) Filed: Oct. 8, 2015

(65) Prior Publication Data

US 2016/0102956 A1 Apr. 14, 2016

Related U.S. Application Data

(60) Provisional application No. 62/062,075, filed on Oct. 9, 2014.

(51) Int. Cl.

| | |
|---|---|
| ***F42B 39/02*** | (2006.01) |
| ***F42B 7/02*** | (2006.01) |
| ***F42B 39/00*** | (2006.01) |

(52) U.S. Cl.

CPC ..... *F42B 39/02* (2013.01); *F42B 7/02* (2013.01); *F42B 39/00* (2013.01)

(58) Field of Classification Search

CPC ..... F42B 39/00; F42B 39/02; F42B 7/02

USPC ..... 224/242

See application file for complete search history.

(56) References Cited

U.S. PATENT DOCUMENTS

| | | | | |
|---|---|---|---|---|
| 6,641,015 | B2 * | 11/2003 | Huggins, Jr. | A45C 11/24 224/236 |
| 8,523,030 | B1 * | 9/2013 | Molcho | F42B 27/00 224/191 |
| 9,528,807 | B1 * | 12/2016 | Burnsed, Jr. | F42B 39/02 |
| 9,781,986 | B2 * | 10/2017 | Merzon | A45C 11/00 |
| 2006/0208019 | A1 * | 9/2006 | Rush | A45F 5/00 224/271 |

* cited by examiner

*Primary Examiner* — Justin M Larson
*Assistant Examiner* — Lester L Vanterpool
(74) *Attorney, Agent, or Firm* — Workman Nydegger

(57) ABSTRACT

Artillery grenade holsters are configured to releasably retain one or more artillery grenades. One or more retaining tabs are configured to define a receptacle space for receiving an artillery grenade. The retaining tab(s) flex outwardly during grenade extraction to allow release of the artillery grenade, after which the retaining tab(s) flex back to their original positions. A secondary retaining element links two or more retaining tabs to prevent inadvertent outward flexing. An artillery grenade holster includes a securing cap fixedly attached, by a retention cable, to a back support and releasably attached, by the retention cable, to a securing element of a front support.

18 Claims, 14 Drawing Sheets

1400

ARTILLERY GRENADE HOLSTER

CROSS-REFERENCE TO RELATED APPLICATIONS

This non-provisional application claims priority to and the benefit of U.S. Provisional Patent Application Ser. No. 62/062,075, filed on Oct. 9, 2014, and entitled "ARTILLERY GRENADE HOLSTER," which application is expressly incorporated herein by reference in its entirety.

FIELD OF THE DISCLOSURE

The following disclosure relates generally to wearable holsters configured for releasably retaining one or more artillery grenades and that are configured to be selectably fastened to belts or other strap-like structures.

BACKGROUND

Artillery grenades are useful for a number of military and law enforcement applications. Such an artillery grenade may be fastened and secured in a holster to retain and secure the grenade during transport or other movement. While such an approach is beneficial, there is an ongoing need for improved holsters to further improve the security and retention of grenade holsters while also providing enhanced accessibility for enabling retrieval and extraction of the grenades from the holsters, when desired.

BRIEF SUMMARY

Embodiments of the present disclosure include artillery grenade holsters that are configured in size and shape to releasably retain one or more artillery grenades on demand. Certain embodiments of the artillery grenade holsters are configured to be attached to strap-like structures, such as belts, suspenders, backpack straps, flaps, pockets, cords, MOLLE components (modular lightweight load-carrying equipment components), pouch attachment ladder system (PALS) components, and other such structures.

Certain embodiments include one or more retaining tabs configured to secure an artillery grenade within the holster, the one or more retaining tabs being configured to resiliently flex outward when pressed or forced outward, such as when an artillery grenade is pressed outwardly and/or downwardly against the one or more retaining tabs during a grenade extraction.

In certain embodiments, the one or more retaining tabs are configured to flex back to an equilibrium position when the outward force is discontinued, such as when an artillery grenade is fully extracted from the holster by moving past the one or more retaining tabs.

Certain embodiments include a back support optionally having one or more rigid support members configured to give additional rigidity and/or strength to the back support, such that the back support can preferably maintain rigidity during an artillery grenade extraction.

Certain embodiments include a secondary retaining element configured to detachably connect or link two or more retaining tabs in order to prevent them from flexing outward during periods where retention is desired.

Certain embodiments are directed to a holster configured in size and shape for releasably retaining an artillery grenade, including: a back support comprising an upper end, a lower end, a first side end, and a second side end; a bottom support disposed proximate the lower end of the back support and extending from the back support a distance in a distal direction; a first retaining tab disposed proximate the first side end of the back support and extending from the back support a distance in a distal direction to a first retaining tab terminal; and a second retaining tab disposed proximate the second side end of the back support and extending from the back support a distance in a distal direction to a second retaining tab terminal, the second retaining tab terminal being proximate to the first retaining tab terminal; wherein the area between the first retaining tab, the second retaining tab, the back support, and the bottom support defines a receptacle space.

Certain embodiments are directed to a holster configured in size and shape for releasably retaining an artillery grenade, including: a receptacle space for receiving an artillery grenade, the receptacle space bounded by a back support and a bottom support attached to the back support; a securing cap configured to selectively enclose the receptacle space to retain an artillery grenade within the receptacle space; a stretchable retention cable joining the securing cap to at least one of the back support or bottom support; and a securing cap manipulation element joined to the stretchable retention cable and configured as a graspable structure that enables orientation of the securing cap with respect to one or more of the back support or bottom support.

Certain embodiments are directed to a holster configured in size and shape for releasably retaining an artillery grenade, including: a back support comprising a back upper end, a back lower end, a first back side end, and a second back side end; a bottom support disposed proximate the back lower end of the back support and extending from the back support a distance in a distal direction; a front support disposed proximate the bottom support and opposite the back support, the front support comprising a front upper end, a front lower end, a first front side end, and a second front side end; and a securing cap positioned substantially opposite the bottom support, the securing cap being moveable from an open configuration to a closed configuration in engagement with the front support; wherein the area between the back support, the bottom support, and the front support defines a receptacle space that is sized and shaped to receive and securely hold an artillery grenade; and wherein the securing cap is configured to secure an artillery grenade within the receptacle space when positioned in the closed configuration in engagement with the front support.

Other aspects and advantages of the invention will be apparent from the following description and the appended claims. The various characteristics described above, as well as other features, will be readily apparent to those skilled in the art upon reading the following detailed description, and by referring to the accompanying drawings. This summary is therefore not intended to identify key or essential features of the claimed subject matter, nor is it intended to be used as an aid in limiting the scope of the claims.

BRIEF DESCRIPTION OF THE DRAWINGS

In order to describe various features and concepts of the present disclosure, a more particular description of certain subject matter will be rendered by reference to specific embodiments which are illustrated in the appended drawings. While each embodiment contemplated hereby may not be drawn to scale, at least some of the appended drawings may be drawn to scale. Understanding that these drawings depict just some example embodiments and are not to be considered to be limiting in scope, various embodiments will be described and explained with additional specificity and detail through the use of the accompanying drawings in which.

DETAILED DESCRIPTION

As used herein the terms "strap" and "belt" are used interchangeably to refer to a structure to which one or more embodiments of grenade holsters described herein may be attached. It will be appreciated that these terms can also include other structures, such as flaps, pockets, cords, components of modular lightweight load-carrying equipment (MOLLE) components, pouch attachment ladder system (PALS) components, and other structures that are configured in size and shape to pass through or fasten to the holster structures described herein.

Figure 1:
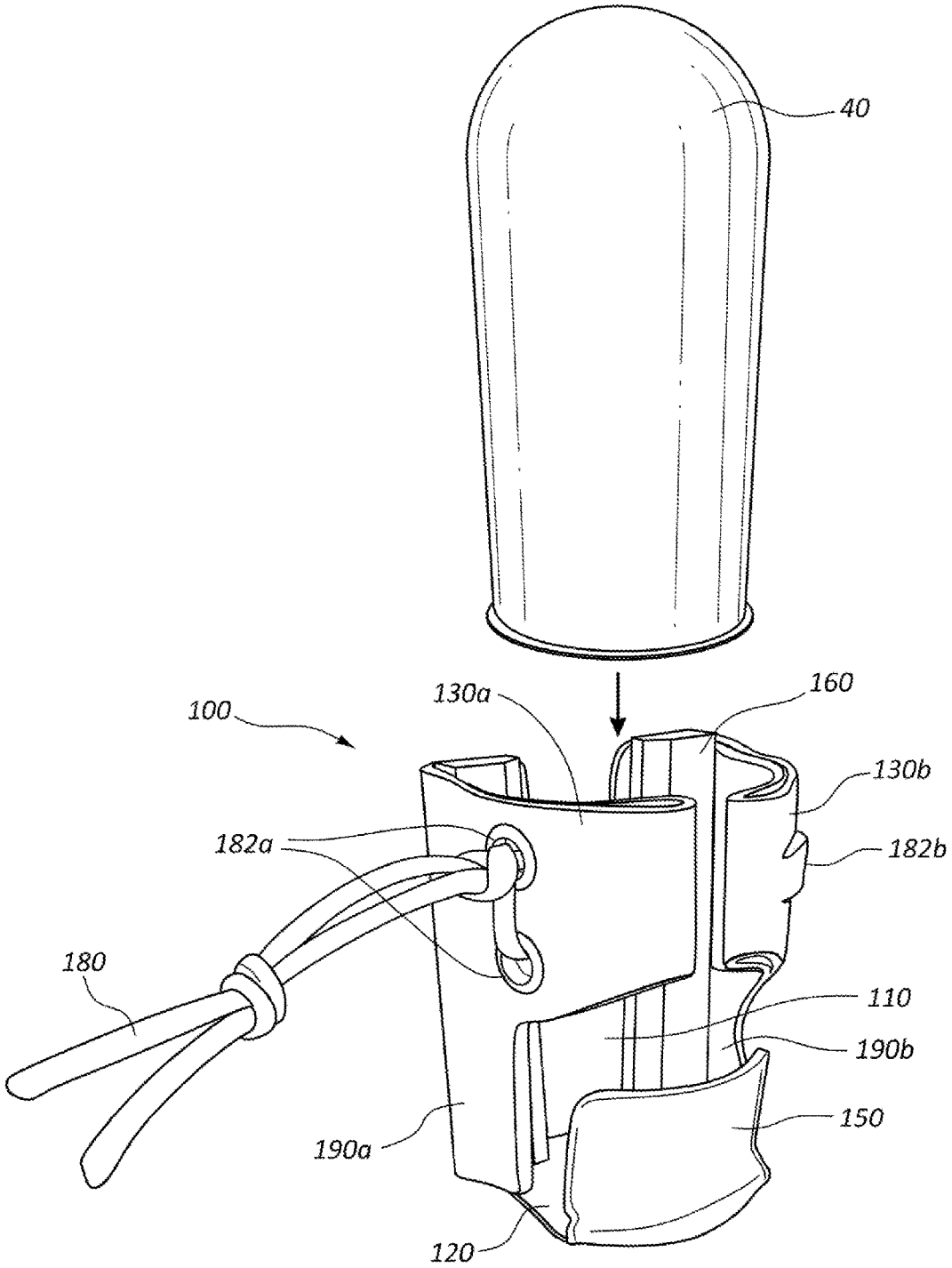
FIG. 1 illustrates an isometric view of an artillery grenade holster according to one embodiment of the present invention, displayed with a grenade.

FIG. 1 illustrates an embodiment of an artillery grenade holster 100 including a back support 110, a bottom support 120, a first retaining tab 130*a*, a second retaining tab 130*b*, a first side support 190*a*, a second side support 190*b*, and a bottom tab 150. Though all of the embodiments illustrated herein include these elements (with like reference numerals indicating like components), one of skill in the art will recognize that certain elements may be wholly or partially omitted without departing from the spirit and scope of the description. For example, in some embodiments, one or more of the first side support 190*a*, the second side support 190*b*, and/or the bottom tab 150 may be omitted. Some embodiments may also wholly or partially omit a first retaining tab 130*a* or a second retaining tab 130*b*, or may include additional retaining tabs configured in a manner similar to the first and second retaining tabs 130*a* and 130*b* (as discussed below).

The holster 100 may be made from a variety of different materials or combinations of materials, including plastics, thermoplastics, rubbers, metals, leather, ceramics, fabrics, and combinations thereof. In some embodiments, the back support 110, bottom support 120, first retaining tab 130*a*, second retaining tab 130*b*, first side support 190*a*, second side support 190*b*, and bottom tab 150 are made from a thermoplastic acrylic-polyvinyl chloride, such as Kydex® material.

In other embodiments, the back support 110, bottom support 120, first retaining tab 130*a*, second retaining tab 130*b*, first side support 190*a*, second side support 190*b*, and bottom tab 150 are made from leather. In some embodiments, the material(s) making up the holster 100 are substantially seamless or contiguous. In other embodiments, the holster 100 or portions of the holster 100 may be webbed, or may be formed in a mesh, framework or scaffolding structure.

The shape of the holster 100 can be formed through a thermoforming process, including the application of heat and/or pressure. In other embodiments, depending on the materials used, one or more components of the holster can be 3-D printed, cast, and/or molded into their corresponding shapes. While the illustrated holster 100 is an integral unit, it will be appreciated that any portion of the holster can be integrally connected or detachably connected and can involve any number of manufacturing, joining, and/or fastening processes during assembly.

In some embodiments, the side supports and retaining tabs (including a bottom tab) are configured in size and shape to directly bias against a grenade positioned between the side supports and retaining tabs of the holster 100. The holster 100 is specifically configured, in some embodiments, to frictionally receive and releasably retain an artillery grenade 40 such as, but not limited to, a 40 mm grenade, (e.g., a 40×46 mm grenade, 40×47 mm grenade, 40×51 mm grenade, and so forth). In other embodiments, the holster 100 is configured in size and shape to receive and releasably retain a 37 mm grenade or another caliber of grenade.

The back support 110 may have a height within a range of about 3 inches to about 6 inches. In other embodiments, the back support 110 may have a height within a range or about 3.5 to about 5.5 inches, or between about 4 to about 5 inches. In other embodiments, the back support 110 may have a height that is less than 3 inches or greater than 6 inches.

The back support 110 may have a thickness within a range of about 0.02 inches to about 0.3 inches. In other embodiments, the back support 110 may have a thickness within a range of about 0.05 inches to about 0.2 inches, or between about 0.08 inches to about 0.15 inches. In other embodiments, the back support 110 may have a thickness that is less than 0.02 inches or greater than 0.3 inches. For example, the back support 110 may have a thickness that is sized to give a desired level of rigidity and/or support to suit a user's needs and preferences. The back support 110 may have a thickness that is uniform or non-uniform. For example, the back support 110 or portion thereof may include ribs, studs, or other structures to provide greater rigidity and/or support. The thickness of the back support 110 may include one or more layers of material, such that the thickness may be 1-ply, 2-ply, 3-ply, or a greater number of layers in order to provide a desired thickness, rigidity, and/or level of strength.

The back support 110 may have a width within a range of about 1 inch to about 3 inches. In other embodiments, the back support 110 may have a width within a range of about 1.25 inches to about 2 inches, or between about 1.5 inches to about 1.75 inches. In other embodiments, the width may be less than 1 inch or greater than 3 inches.

Figure 4:
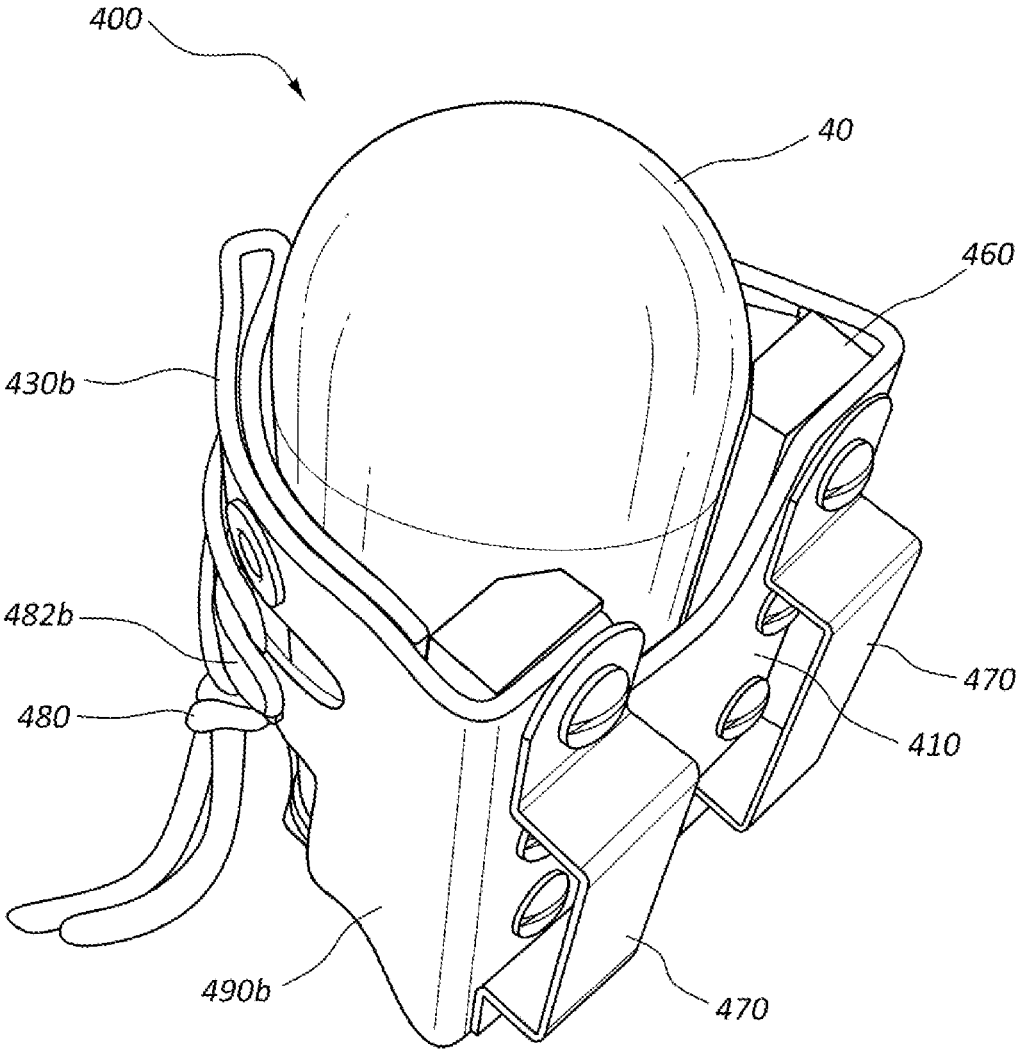
FIG. 4 illustrates another isometric view of an artillery grenade holster according to one embodiment of the present invention with an artillery grenade secured and retained within the holster, this view showing the back side of the holster and a holster fastening structure.
Figure 5:
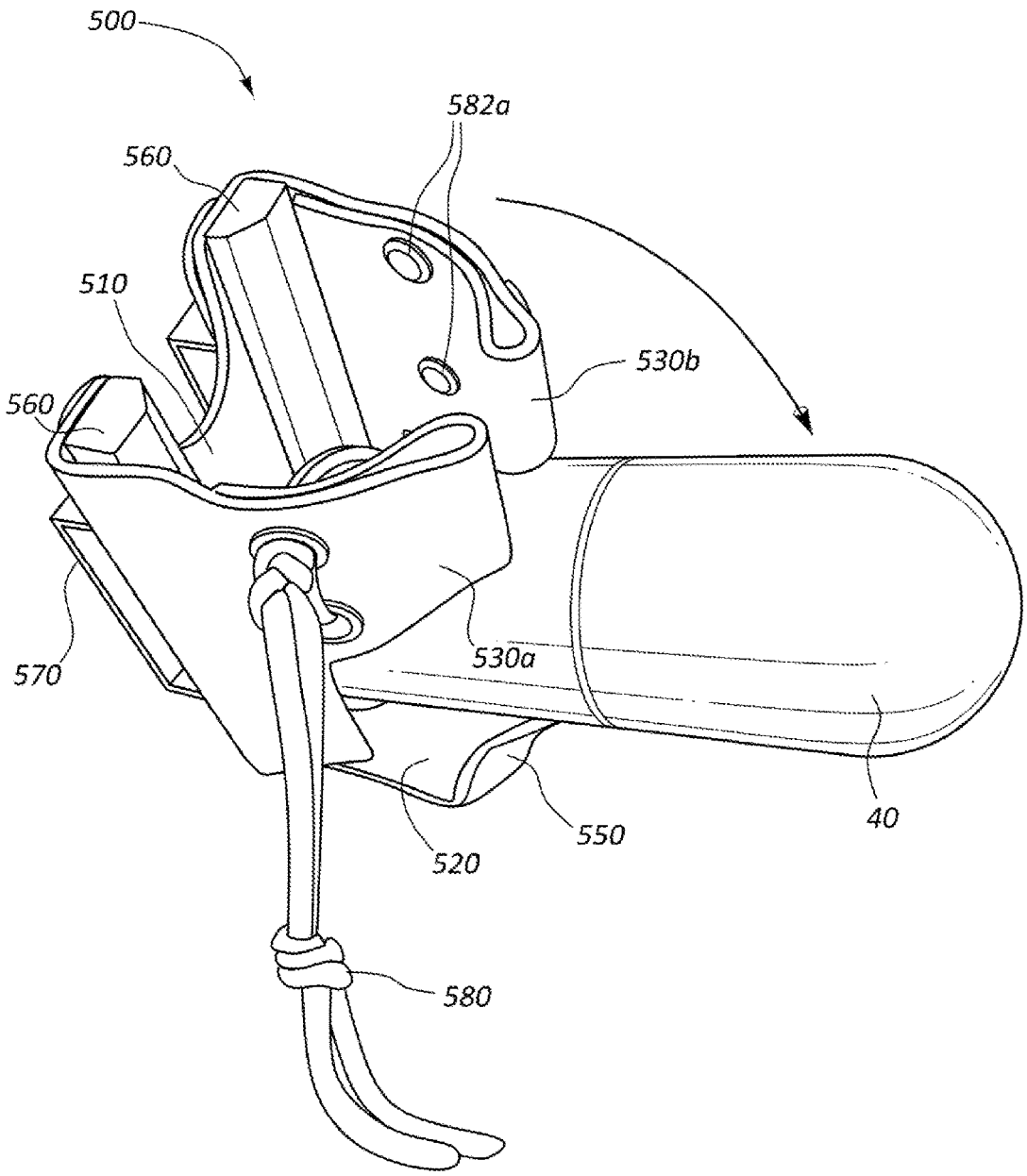
FIG. 5 illustrates an isometric view of an artillery grenade holster according to one embodiment of the present invention during one stage of an artillery grenade extraction from the holster.

In the embodiment illustrated in FIG. 1, the back support 110 includes a trough or notch between outer sides of the back support (see also FIGS. 4 and 5 for additional views). The notched portion of the back support 110 may aid in the securing and fitting of an artillery grenade 40 against the back support 110, and/or may beneficially reduce the overall weight of the holster 100. In other embodiments, the back support 110 may include more than one notch, or may include one or more notches, protrusions, or other extensions and/or indentations at other portions of the back support 110.

In the embodiment illustrated in FIG. 1, a bottom support 120 is joined to the back support 110 proximate to a lower end of the back support 110. The bottom support 120 is integrally joined to the back support 110 and extends away from the back support 110 at a substantially transverse (e.g., horizontal) angle to the back support 110 (e.g., the back support 110 and the bottom support 120 form an angle of about 90 degrees where joined). In other embodiments, however, the back support 110 and the bottom support 120 may be formed separately and may be attached through other means, such as through adhesives, welding, crimping, heat-welding, and/or through mechanical fastening (e.g., pins, clips, rivets, nails, staples, etc.). Additionally, in some embodiments the bottom support 120 may extend at a transverse angle that is not substantially horizontal (e.g., about 45, 60, 75, 105, 120, or 135 degrees).

As discussed above in relation to the back support 110, the bottom support 120 may have a thickness within a range of about 0.02 inches to about 0.3 inches, within a range of about 0.05 inches to about 0.2 inches, or within a range of about 0.08 inches to about 0.15 inches, though in other embodiments the thickness may be less than 0.02 inches or greater than 0.3 inches. The bottom support 120 may have a thickness that is uniform or non-uniform. For example, the bottom support 120 or portion thereof may include ribs, studs, or other structures to provide greater rigidity and/or support. The thickness of the bottom support 120 may include one or more layers of material, such that the thickness may be 1-ply, 2-ply, 3-ply, or a greater number of layers in order to provide a desired thickness.

The bottom support 120 preferably has a width substantially equal to the width of the back support 110, and the bottom support 120 preferably extends from the back support 110 a distance substantially great enough to accommodate a grenade positioned between a bottom tab (referenced below) and the back support, while enabling the bottom tab to flexibly bias against the grenade.

In some embodiments, the bottom support 120 extends from the back support 110 a distance within a range of about 1 inch to about 3 inches. In other embodiments, the distance is within a range of about 1.25 inches to about 2 inches, or from about 1.5 inches to about 1.75 inches. In other embodiments, the distance may be less than 1 inch or greater than 3 inches.

The artillery grenade holster 100 illustrated in FIG. 1 includes two rigid support members 160, each joined to the back support 110 (see also FIGS. 4-8 for additional views) to provide additional rigidity to the back support 110. The rigid support members 160 may be formed from any material that can provide additional rigidity, strength, and/or structure to the back support, such as metal, plastic (including Kydex®), ceramic, wood, or other substantially rigid material.

Preferably, the rigid support members 160 have a rigidity and/or provide a rigidity to the back support 110 that is greater than the rigidity of the back support 110 alone. In some embodiments, the rigid support members 160 may be omitted, or there may be only one rigid support member 160. In other embodiments, there may be three, four, or more rigid support members 160, and the support member(s) may be attached to the holster 100 at the back support 110 and/or at other portions of the holster 100.

In the illustrated embodiment, the rigid support members 160 have a generally linear shape, and are connected to the back support 110 in a vertical configuration. In other embodiments, one or more rigid support members may have another shape and/or may be offset at a different angle. For example, in some embodiments, rigid support members 160 may cross each other to form a grid or webbed pattern, or one or more rigid support members 160 may be formed in a grid or webbed pattern or shape. The rigid support members 160 can also be positioned on an inside surface or outside surface of the back support 110.

In the illustrated embodiment, the rigid support members 160 include a chamfered edge configured to aid in securing and fitting an artillery grenade 40 against the back support 110. In other embodiments, rigid support members 160 may be curved or otherwise shaped to fit the contours of an artillery grenade as it is pressed against the back support 110.

In the embodiment illustrated in FIG. 1, a first retaining tab **130*a* and a second retaining tab 130*b* are each joined to the back support 110 proximate an upper end of the back support 110, with the first retaining tab 130*a* and the second retaining tab 130*b* joined to opposite sides of the back support 110, respectively. The first retaining tab 130*a* and the second retaining tab 130*b* each extend at an angle transverse to the back support 110 (e.g., to form an angle of about 90 degrees where joined). In other embodiments, the first retaining tab 130*a* and/or the second retaining tab 130*b* may extend from the back support 110** at various angles (e.g., about 45, 60, 75, 105, 120, or 135 degrees).

In the embodiment illustrated in FIG. 1, the first retaining tab **130*a* and the second retaining tab 130*b* are integrally joined to the back support 110. In other embodiments, the back support 110, the first retaining tab 130*a*, and/or the second retaining tab 130*b*** may be formed separately and attached through other means, such as through adhesives, welding, crimping, heat-welding, and/or through mechanical fastening (e.g., pins, clips, rivets, nails, staples, etc.).

As illustrated in FIG. 1 (see also FIGS. 4-8 for additional views), the first retaining tab **130*a* and the second retaining tab 130*b* include multi-layered portions. In the embodiment illustrated, the first retaining tab 130*a* extends from the back support 110 to a terminal end and then folds inwardly back on itself to form the multi-layered portion. Similarly, the second retaining tab 130***b* extends from the back support 110 to a terminal end and then folds inwardly back on itself to form the multi-layered portion. In some embodiments, the first retaining tab 130*a* and/or the second retaining tab 130*b* and/or any other retaining tabs may omit the multi-layered portions. In other embodiments, the first retaining tab 130*a* and/or the second retaining tab 130*b* and/or any other retaining tabs may include portions that are 2-ply, 3-ply, 4-ply, or greater numbers of layers.

In the illustrated embodiment, the first retaining member 130*a* and the second retaining member 130*b* have a curved shape such that they each curve inwardly, toward each other, to form a receptacle space between the first retaining tab 130*a*, the second retaining tab 130*b*, the back support 110, and the bottom support 120. The receptacle space is sized to frictionally receive an artillery grenade 40, such that the first retaining tab 130*a*, the second retaining tab 130*b*, the back support 110, and the bottom support 120 all bias directly against a grenade chambered within the holster 100.

In a preferred embodiment, the receptacle space is sized such that a 40 mm artillery grenade 40 fits securely against the bottom support 120, the back support 110, the first retaining member 130*a*, and the second retaining member 130*b* when positioned within the receptacle space of the holster 100. In other embodiments the holster 100 is configured to securely engage a 37 mm grenade or another sized grenade.

Some embodiments, such as the illustrated embodiment, may additionally include a bottom tab 150. The bottom tab 150 is joined to the bottom support 120 and extends vertically from the bottom support 150. The bottom tab 150 may be integrally attached to the bottom support 120 or may be formed as a separate piece and joined in a manner as discussed above in relation to the joining of the bottom support 120 to the back support 110. The bottom tab 150 may extend up to the first retaining tab 130*a* and/or second retaining tab 130*b*, or the bottom tab may extend only partially to the first retaining tab 130*a* and/or second retaining tab 130*b*. In other embodiments, the bottom tab 150 may extend up to and overlap with the first retaining tab 130*a* and/or second retaining tab 130*b*, such that it is positioned on the inside or outside of the first retaining tab 130*a* and/or second retaining tab 130*b*.

As will be discussed in greater detail below, the first retaining tab 130*a*, the second retaining tab 130*b*, and the bottom tab 150 are all configured to resiliently and flexibly retain position, such that they may be flexed outward upon subjection to an outward force, and such that they may flex inwardly to restore an equilibrium position upon discontinuation of the outward force. In some embodiments, the bottom support 120, the first side support 190*a*, and/or the second side support 190*b* may also be configured to resiliently flex outward upon subjection to an outward force before flexing inwardly to restore an equilibrium position upon discontinuation of the outward force.

In some embodiments, for flexibly biasing the bottom tab 150 against a holstered grenade, the distance between the back support 110 and the bottom tab 150 is slightly less than a diameter of a 40 mm grenade, or any other grenade prior to positioning the grenade therein between. Similarly, the interior circumference of the holster defined by the side supports, the back support and the retaining tabs, can be slightly less than the circumference of a grenade, prior to a grenade being positioned within the holster 100.

Figure 2:
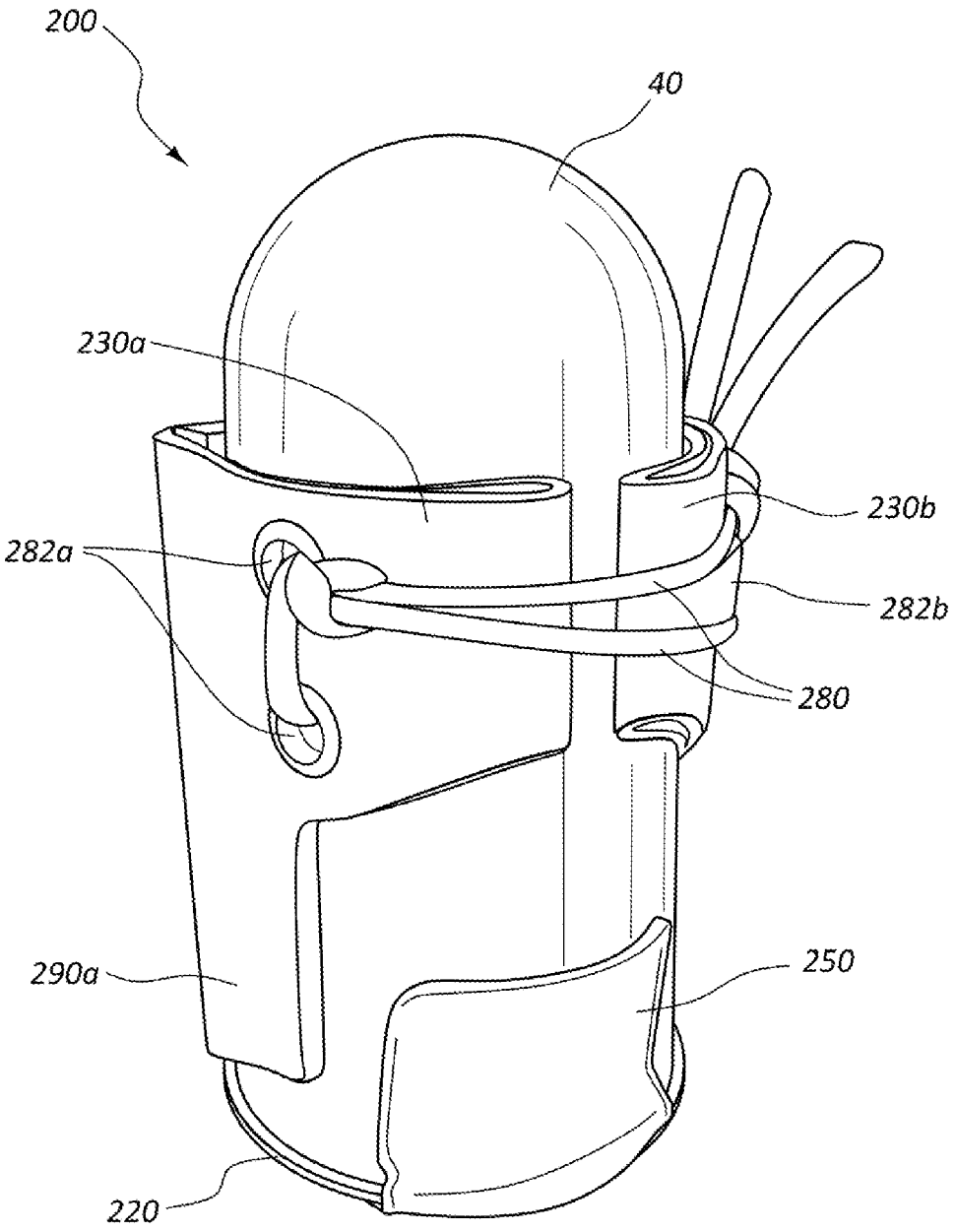
FIG. 2 illustrates an isometric view of an artillery grenade holster according to one embodiment of the present invention with an artillery grenade secured and retained within the holster.

Referring now to FIG. 2, an artillery grenade holster 200 is configured with a receptacle area configured to receive an artillery grenade 40. The holster 200 is preferably configured such that when an artillery grenade 40 is placed within the holster 200, the artillery grenade 40 is secured against the bottom support 220, the back support 210, the first retaining tab 230*a*, the second retaining tab 230*b*, and the bottom tab. Additionally, the artillery grenade 40 may be secured against a first side support 290*a* and a second side support 290*b*.

The embodiment shown in FIG. 2 also includes a secondary retaining element 280 linking the first retaining tab 230*a* and the second retaining tab 230*b* to prevent the first retaining tab 230*a* and/or the second retaining tab 230*b* from flexing outwardly. In other embodiments, the secondary retaining element 280 may also be attached to the bottom tab 250, or may secure the bottom tab 250 from flexing outward upon subjection to an outward force. Certain embodiments may omit the secondary retaining element 280, while other embodiments may include two or more secondary retaining elements.

The secondary retaining element 280 may be a cord, rope, tie, zip-tie, strand, string, bungee, or other material that may be looped, braided, and/or tied together. In other embodiments, the secondary retaining element 280 may be a strap, belt, Velcro® materials, and/or other fastening structure or combination of structures. In yet other embodiments, the secondary retaining element 280 may be a clip or clasp, or may include linking portions configured to engage with each other in order to link the retaining tabs together and lock them into position and/or prevent them from flexing outward.

The holster 200 may include secondary retaining element connectors 282*a* and 282*b* that are configured to allow the secondary retaining element 280 to be looped through, threaded through, attached to, or tied onto the holster in a secure fashion. The connector 282*b* in the present embodiment is a hook configured to allow the secondary retaining element 280 to loop through, wrap around, or tie onto (see also FIG. 3 for an additional view). For example, an artillery grenade 40 may be placed in a holster 200, and a secondary retaining element 280 may be looped through connectors 282*a* and 282*b* before being tied together or otherwise secured, thereby linking the first retaining tab 230*a* and the second retaining tab 230*b* in order to prevent them from flexing outwardly and to further secure the artillery grenade 40 within the holster 200. In other embodiments, secondary retaining element connectors 282*a* and/or 282*b* may include slots, clips, posts, buckles, clamps, clasps, harnesses, or other fastening means for connecting a secondary retaining element 280.

Figure 3:
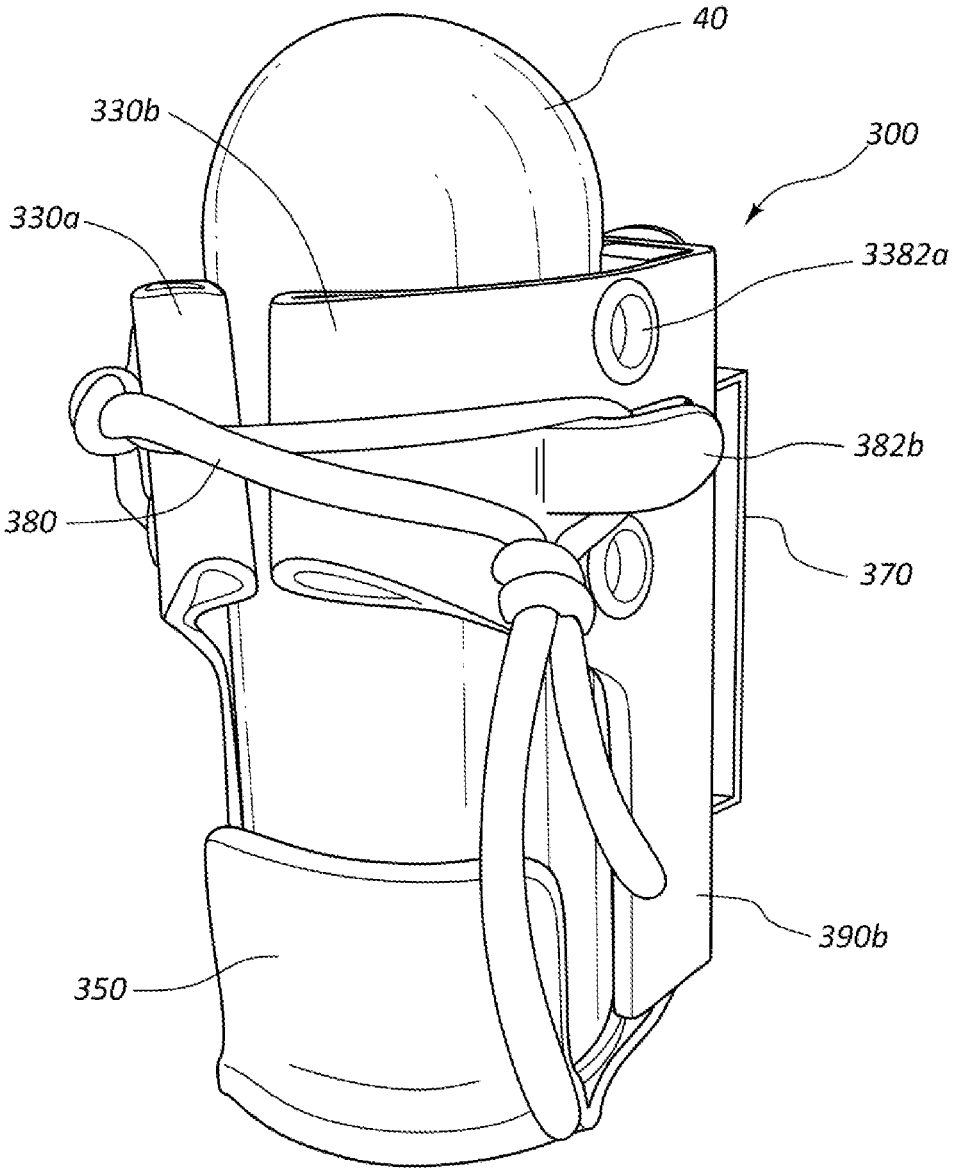
FIG. 3 illustrates another isometric view of an artillery grenade holster according to one embodiment of the present invention with an artillery grenade secured and retained within the holster.

Referring now to FIG. 3, the illustrated embodiment of a holster 300 includes secondary retaining element connectors 382*a* as holes and secondary retaining element connector 382*b* as a hook, with both types of connectors 382*a* and 382*b* positioned on the same side of the holster 300 (e.g., on second retaining tab 330*b*). Though the connectors 382*a* that are formed as holes and are located on the same retaining tab 330*b* as the connector 382*b* that is formed as a hook are not used in the illustrated embodiment, in other embodiments they may provide additional positions for looping, threading, and/or tying the secondary retaining element 380.

The connectors 382*a* and 282*a* can also comprise fasteners (e.g., grommets or other fasteners) that are configured to secure multiple plys of material forming the retaining tabs. For instance, the retaining tabs are presently shown to include two plys of material that are formed by folding the Kydex® or other material back onto itself. It is then secured in place by the connectors 382*a* and 282*a*.

Also illustrated in FIG. 3 is a holster fastening structure 370. In the illustrated embodiment, the holster fastening structure 370 is a bracket forming an enclosed loop or open slot configured to receive a belt, strap, or similar structure as defined previously. In other embodiments, the holster fastening structure 370 may include a clasp, clip, buckle, hook or other fastening means.

Referring now to FIG. 4, a holster fastening structure 470 is shown attached to the back support 410 of a holster 400. In this embodiment, the holster fastening structure 470 includes a pair of brackets forming a pair of enclosed slots when the brackets of the fastening structure 470 are connected to the back support 410. As shown in the Figure, the fastening structure 470 may be attached to the back support 410 at or proximate to the portion(s) of the back support that attach to one or more rigid support members 460. For example, the fastening structure 470 may be screwed, riveted, or otherwise fastened to the back support 410 and/or the rigid support member(s) 460 by passing one or more screws, rivets, nails, or other fasteners through the holster fastening structure and into the back support 410 and/or the rigid support member(s). In the illustrated embodiment, for example, the brackets of the holster fastening structure 470 are generally aligned with the rigid support members 460, and are secured to the holster 400 by passing screws through the brackets and the back support 410 and into the rigid support members 460. It will be appreciated that the brackets can be formed from any material, including metal and plastic, which are configured to securely engage a belt or strap.

FIG. 5 illustrates an embodiment of an artillery grenade holster 500 during extraction of an artillery grenade 40 from the holster 500. When a grenade is pushed downward and/or outward, as shown in the Figure, an outward force is applied to the first retaining tab 530*a*, the second retaining tab 530*b*, and the bottom tab 550. Upon application of this force, the first retaining tab 530*a*, the second retaining tab 530*b*, and the bottom tab 550 flex outward, thereby opening and enlarging the receptacle space. As the artillery grenade 40 continually pushes out and/or down against the first retaining tab 530*a* and the second retaining tab 530*b*, the first retaining tab 530*a* and the second retaining tab 530*b* flex to the point that the artillery grenade 40 can pass through the gap between the first retaining tab 530*a* and the second retaining tab 530*b*, to the position shown in FIG. 5. At this point in the process of extracting an artillery grenade, the first retaining tab 530*a* and the second retaining tab 530*b* will flex back into the equilibrium position, while the bottom tab 550 continues to flex against the artillery grenade 40. Upon continued downward and/or outward movement of the artillery grenade 40, the artillery grenade 40 will move past the bottom tab 550 and out of the holster 500.

Figure 6:
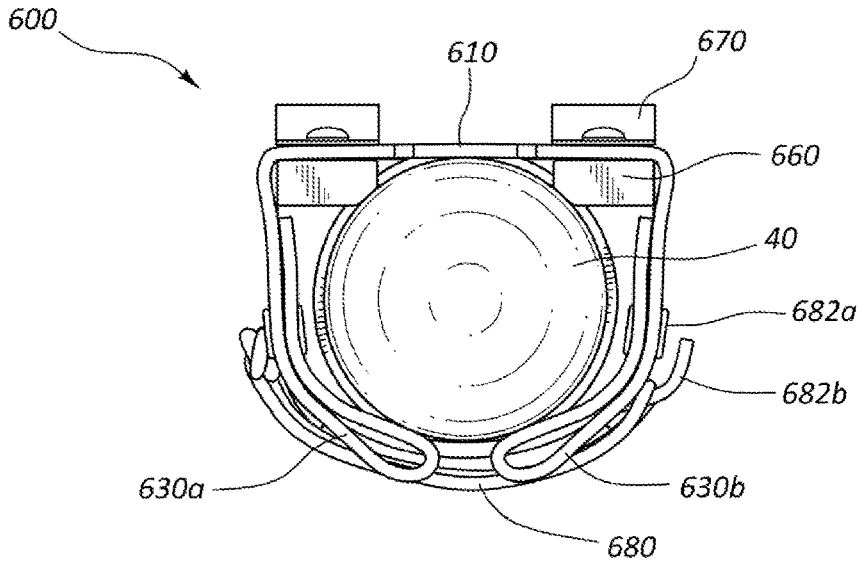
FIG. 6 illustrates a top view of an artillery grenade holster according to one embodiment of the present invention, with a grenade holstered therein.
Figure 7:
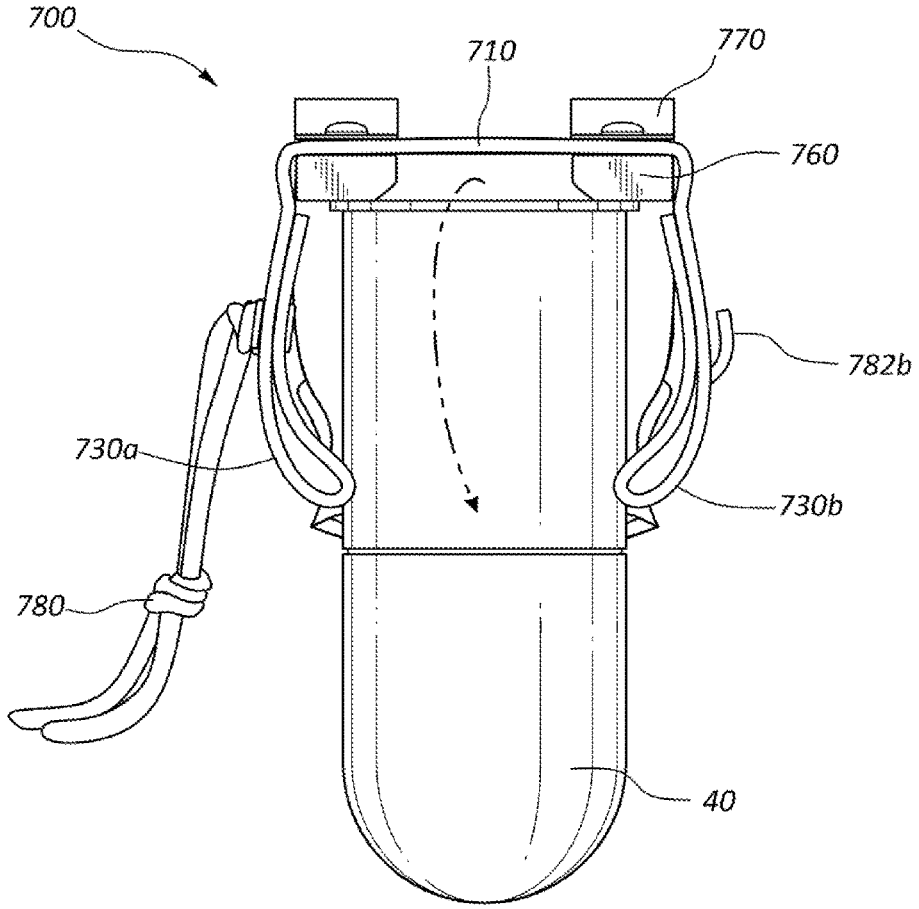
FIG. 7 illustrates a top view of an artillery grenade holster according to one embodiment of the present invention during a stage of an artillery grenade extraction from the holster.
Figure 8:
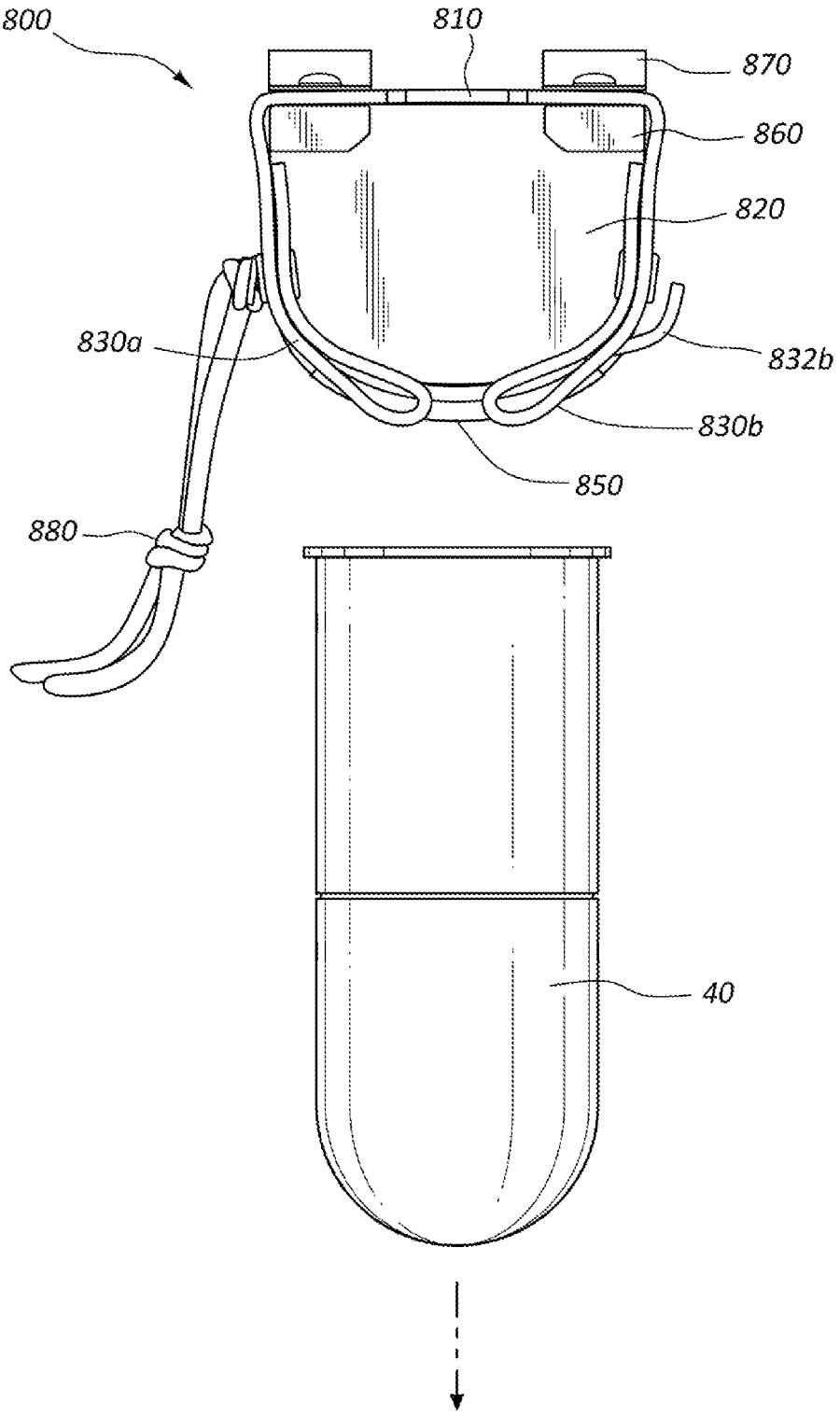
FIG. 8 illustrates a top view of an artillery grenade holster displayed with an artillery grenade configured to fit within the grenade holster according to one embodiment of the present invention.

FIGS. 6-8 illustrate top views of artillery grenade holsters during various stages of grenade extraction. FIG. 6 shows an artillery grenade holster 600 with an artillery grenade 40 secured within the receptacle space of the holster 600. The first retaining tab 630*a* and the second retaining tab 630*b* are linked together and secured against the artillery grenade 40 by a secondary retaining element 680.

FIG. 7 illustrates extraction of an artillery grenade 40 from a holster 700. In this Figure, the secondary retaining element 780 has been detached from the second retaining tab 730*b*, thereby unlinking the first retaining tab 730*a* and the second retaining tab 730*b*. As the artillery grenade 40 is forced downward and/or outward, the artillery grenade 40 presses against the first retaining tab 730*a* and the second retaining tab 730*b*, causing them to flex outward and allowing an upper portion of the artillery grenade 40 to begin to pass into the gap between the first retaining tab 730*a* and the second retaining tab 730*b*, as shown in FIG. 7. Upon further downward and/or outward movement of the artillery grenade 40, the artillery grenade 40 will pass through the gap between the first retaining tab 730*a* and the second retaining tab 730*b*, and the first retaining tab 730*a* and the second retaining tab 730*b* will flex back to their equilibrium positions, as shown in FIG. 5.

FIG. 8 illustrates a completed extraction of an artillery grenade 40 from an artillery grenade holster 800. As the artillery grenade 40 is fully removed from the holster 800, the first retaining tab 830*a*, the second retaining tab 830*b*, and the bottom tab 850 flexibly return to their equilibrium positions, thereby restoring the receptacle space of the holster 800 to receive and secure another artillery grenade.

Figure 9:
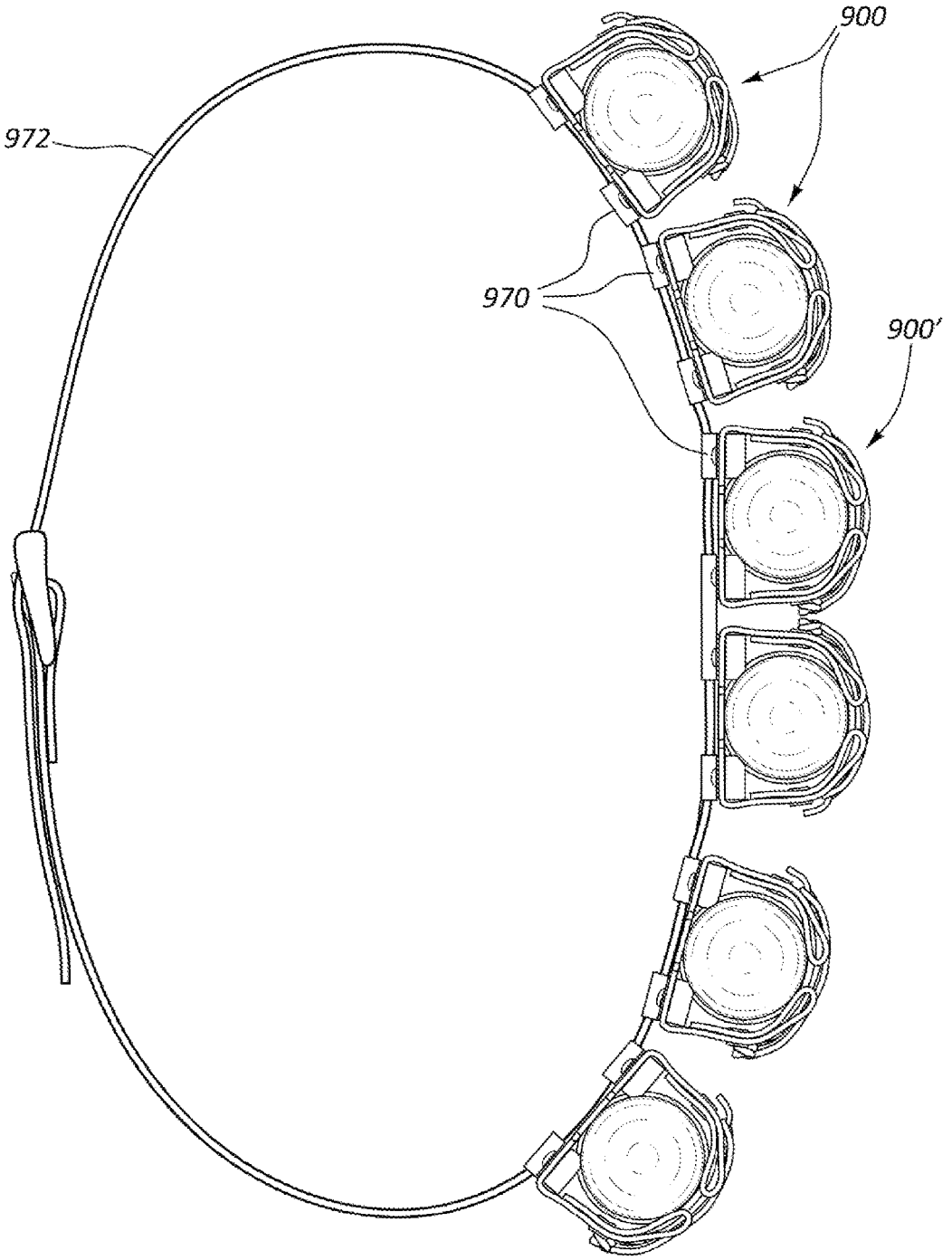
FIG. 9 shows multiple artillery grenades fastened to a strap or belt in a modular fashion, including a multi-grenade holster attached to the strap or belt according to one embodiment of the present invention.

FIG. 9 illustrates multiple artillery grenade holsters 900 secured to a belt or strap 972. The strap 972 may be a belt, strap, or other similar structure as defined previously. FIG. 9 illustrates that a plurality of holsters 900 may be connected to a strap 972 in a modular fashion. For example, as shown in the Figure, a strap 972 may be passed through multiple holster fastening structures 970 of multiple holsters 900.

In some embodiments, an artillery grenade holster 900 may be formed as a multi-grenade holster. For example, a single artillery holster back support can be configured with a sufficient width to secure two or more artillery grenades against the back support.

Additionally, or alternatively, a multi-grenade holster 900 may be formed by joining two or more holsters along adjacent side supports or portions thereof, or by forming two or more holsters to have shared side supports or that include integrally connected side supports.

In one embodiment, as shown in FIG. 9, a dual grenade holster 900' is formed by attaching two holster back supports to a shared fastener structure positioned therein between. In this embodiment, any hooks or other similar secondary retaining member connectors are preferably placed on opposing outer sides of the dual grenade holster (as shown), thereby providing quicker and easier attachment and detachment of any secondary retaining elements secured by looping around the hooks or similar connectors.

Figure 10:
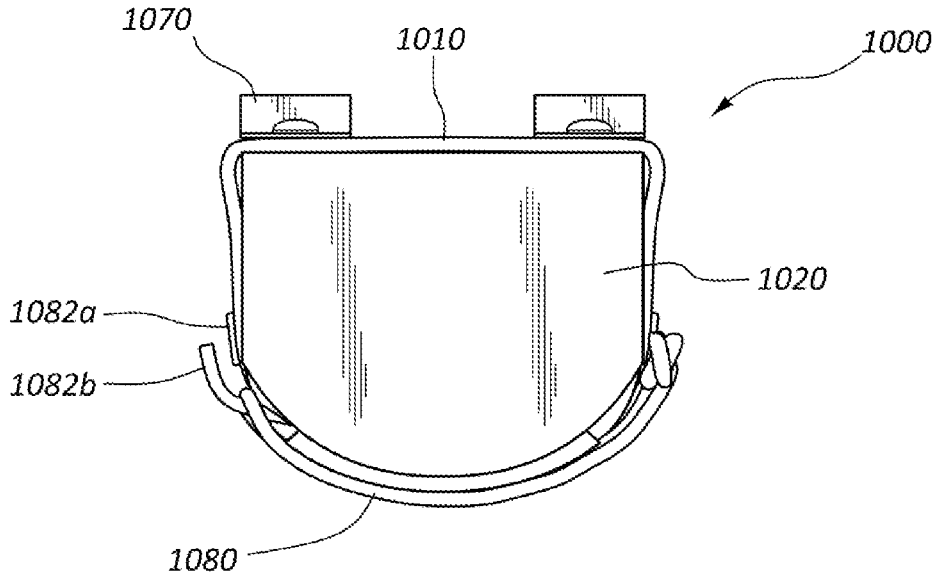
FIG. 10 illustrates a bottom view of an artillery grenade holster according to one embodiment of the present invention.

FIG. 10 illustrates an artillery grenade holster 1000 as depicted from a bottom perspective. As shown, grenade holster 1000 includes a bottom support 1020 which is transverse with respect to back support 1010, and back support 1010 includes two holster fastening structures 1070. In some embodiments, the back support 1010 may include one or more holster fastening structures 1070, including the embodiment depicted in FIG. 10 where the back support 1010 is associated with two holster fastening structures 1070. FIG. 10 further illustrates secondary retaining element 1080 secured to secondary retaining element connectors 1082*a* and 1082*b*.

FIG. 10 and other previous figures depict the bottom support 1020 as being substantially flat. A flat bottom support may be desirable in embodiments configured for receiving the base portion of a grenade (e.g., the flat portion opposite the nose of the grenade) against the bottom support, for example. In other embodiments, the bottom support of the present invention has an arcuate surface (e.g., concave from a perspective above the bottom support) such that the grenade 40, when oriented with the forward side (e.g., the nose of the grenade) towards the bottom support, is configured to snugly receive the forward side of the grenade 40 while maintaining the other properties of bottom support as described in foregoing embodiments and figures.

Figure 11:
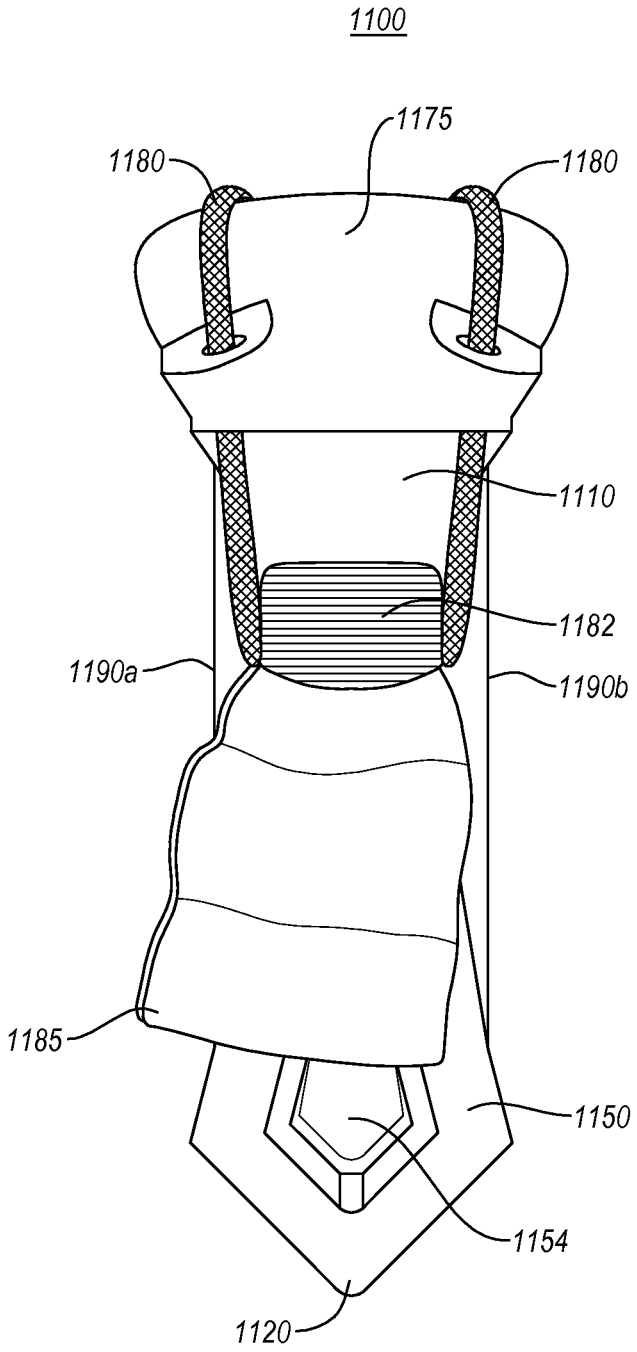
FIG. 11 illustrates a front view of a closed artillery grenade holster according to one embodiment of the present invention.

Referring now to FIG. 11, illustrated is a front end view of an artillery grenade holster 1100 according to one embodiment of the present disclosure. As shown in FIG. 11, grenade holster 1100 includes back support 1110, bottom support 1120, and front support 1150. The grenade holster 1100 of FIG. 11 is depicted with securing cap 1175 in a closed position in engagement with front support 1150. That is, as depicted in FIG. 11, the securing cap 1175 is oriented opposite bottom support 1120 and associated retention cables 1180 are releasably attached to the securing cap attachment element 1182 of front support 1150.

The retention cables 1180 may, in one embodiment, be selectively flexible and/or stretchable and constructed partially and/or wholly from elastic material. In one embodiment, the retention cables 1180 may include elastic cords sheathed in braided polypropylene such as, for example, a bungee cord. In another embodiment, the retention cables 1180 are constructed from a rubber, thermoplastic elastomer, or other stretchable material or combination of stretchable materials. In another embodiment, the retention cables 1180 are not constructed from or do not include substantially flexible material. As a non-limiting example, the securing straps according to the present invention may include braided and/or aggregated strands of nylon, polypropylene, polyester, and/or high performance fibers such as, for example, aramid fibers, or a combination of any of the foregoing. In other embodiments, the retention cables are formed as straps, ties, cords, rope, string, belts, or other structures similar to those described herein in relation to other secondary retaining elements. One or more retention cables may be included.

As illustrated in FIG. 11, securing cap manipulation element 1185 is associated with retention cables 1180 and is configured to be positioned beneath securing cap attachment element 1182 when the holster 1100 is in a closed configuration. In one embodiment, the securing cap manipulation element 1185 may be used to orient, secure, move, and/or unsecure the securing cap 1175. In one embodiment, securing cap manipulation element 1185 is a flap and/or tab of fabric. In another embodiment, the securing cap manipulation element 1185 is made of a thermoplastic, thermoplastic elastomer, plastic, rubber, wood, metal, combinations thereof, or any other material and/or graspable structure enabling a user to manipulate, move, fasten, and/or orient the securing cap 1175 with respect to the rest of the holster 1100.

Also as depicted in FIG. 11, the securing cap attachment element 1182 is positioned at or near the front upper end of front support 1150. In one embodiment, the securing cap attachment element 1182 is attached and/or an integral part of front support 1150 and includes a lip and/or ledge to releasably secure securing straps 1180 when the securing cap is in a closed configuration.

In one embodiment, the securing cap attachment element 1182 may be attached and/or associated with a middle, side, or lower front end of front support 1150. In another embodiment, the securing cap attachment element 1182 is releasably attached to front support 1150 and may be associated with a middle, side, or lower front end of front support 1150. In one embodiment, the securing cap attachment element 1182 may be attached to one or more portions of the bottom support 1120. In one embodiment, a securing cap in a closed configuration may engaged with a securing cap attachment element 1182 associated with the front and/or bottom support.

In some embodiments, the securing cap attachment element 1182 is adjustable, and may be moved to different positions along the front support 1150 (or other portions of the holster 1100) in order to, for example, provide adjustable tensioning of retention cables 1180 when attached to the securing cap attachment element 1182.

In one embodiment, securing cap attachment element 1182 may include a ledge, lip, and/or groove configured in width to receive retention cables 1180 and/or at least a portion of securing cap manipulation element 1185. In one embodiment, the securing cap attachment element is a notch configured to receive at least a portion of retention cables 1180 and/or securing cap manipulation element 1185. In such an embodiment, the securing cap manipulation element may be a knot or bulbous region of retention cable 1180.

In some embodiments, the securing cap attachment element 1182 and the securing cap manipulation element 1185 are replaced by other fastener elements, such as Velcro® or other hook and loop fasteners, snaps, magnetic fasteners, ties, and/or other fasteners.

As illustrated in FIG. 11, back support 1110 includes first and second back side supports 1190*a* and 1190*b*. In one embodiment, back side supports 1190*a*, 1190*b* extend from the back support 1110 in a distal direction away from back support 1110, forming an arch or a circumferential curvature with the back support 1110, in such a manner that they can help provide additional sidewall support for a grenade 40 placed therein.

In one embodiment, the back side supports 1190*a*, 1190*b* extend away from the back support 1110 within a range of about 0.125 inches to about 2 inches. In another embodiment, the back side supports 1190*a*, 1190*b* extend from the back support 1110 in a range of about 0.25 inches to about 1 inch. In yet another embodiment, the back side supports 1190*a*, 1190*b* extend from the back support 1110 in a range of about 0.3 inches to about 0.6 inches.

In some embodiments, the back side supports 1190*a*, 1190*b*, the back support 1110, the bottom support 1120 and the front support 1150, define a receptacle space or chamber for securely holding a grenade positioned within the holster 1100. In one embodiment, the receptacle space or chamber may be secured by a securing cap 1175 positioned substantially opposite the bottom support 1120. The securing cap 1175 may be movable between open and closed configurations to selectively open and close the receptacle space such that when positioned in a closed configuration, the receptacle space and any artillery grenade situated therein may be further secured. In one embodiment, the securing cap 1175 may be moveable from an open configuration to a closed configuration in engagement with the front support 1150.

Depicted in FIG. 11 is vent 1154 positioned at the lower front end of front support 1150 such that the lower end of vent 1154 connects to and/or relieves the top surface of bottom support 1120, during flexing or movement of the front support 1150.

In one embodiment vent 1154 also provides an egress point for particulate matter and/or fluids accumulated on the top surface of bottom support 1120 and/or the receptacle space defined by the area between the back support 1110, the bottom support 1120, and the front support 1150, which may include, but are not limited to, sand, ash, water, soil, pebbles, and/or herbaceous matter.

The holster 1100 may be constructed from a variety of different materials including plastics, thermoplastics, rubbers, metals, leather, ceramics, fabrics, and combinations thereof. In some embodiments, the back support 1110, bottom support 1120, front support 150, and securing cap 1175 are made from a thermoplastic acrylic-polyvinyl chloride, such as Kydex® material. In one embodiment, the holster 1100 is rigid and substantially inflexible. That is, the back support 1110, bottom support 1120, front support 1150, and securing cap 1175 may be made from a material that is rigid and substantially inflexible so as to maintain the structure of the holster 1100 even when subjected to potentially manipulative forces. In one embodiment, the back support 1110, bottom support, 1120, and front support 1150 are integrally connected as the same, uninterrupted material. That is, the foregoing elements represent aspects and/or functional parts of a single unit (e.g., such as through a molding or 3D printing process). In other embodiments, one or more elements may be formed separately and attached via adhesives, welding, stitching, riveting, clamping, or other fastening means.

Figure 12:
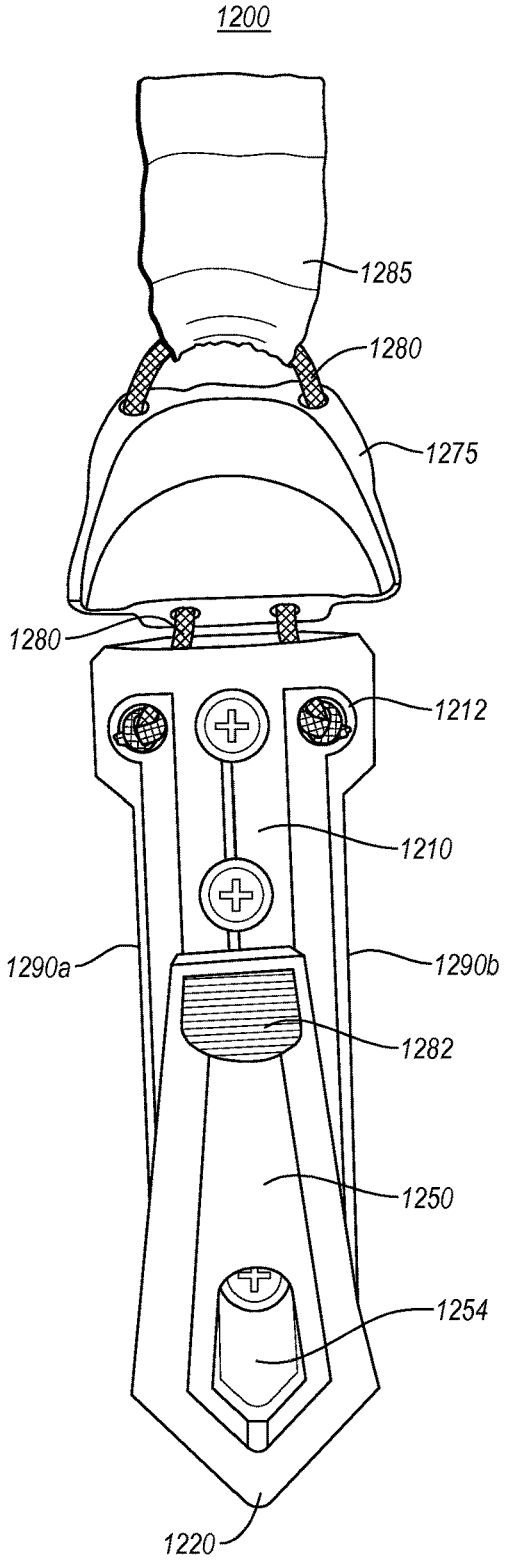
FIG. 12 illustrates a front view of an open artillery grenade holster according to one embodiment of the present invention.

Referring now to FIG. 12, illustrated is a front end view of an open artillery grenade holster 1200 according to one embodiment of the present disclosure. Securing cap 1275, as depicted in FIG. 12, is detached from securing cap attachment element 1282. The interior surface of securing cap 1275 is evidenced in FIG. 12 according to one embodiment of the present disclosure and demonstrates securing cap 1275 having an arcuate surface. In one embodiment, the arcuate surface of securing cap 1275 may be used to snugly fit and or communicate with an artillery grenade 40 positioned within the receptacle space. For example, the arcuate surface of securing cap 1275 may be formed so as to fit against a base end (e.g., the end opposite the nose) of a grenade when the grenade is positioned nose down within the holster 1200 and the securing cap 1275 is positioned over the base end of the grenade.

In one embodiment, and as depicted in FIG. 12, the retention cable 1280 is fixedly attached to the upper back end of back support 1210 and may be releasably attached to the securing cap attachment element 1282 of the front support 1250. In one embodiment, the retention cable 1280 may be fixedly attached to a middle and/or a lower back end of back support 1210 and/or to bottom support 1220. In another embodiment, the retention cable 1280 is fixedly attached to the front support 1250 and releasably attached to the back support 1210 and/or bottom support 1220.

Figure 13:
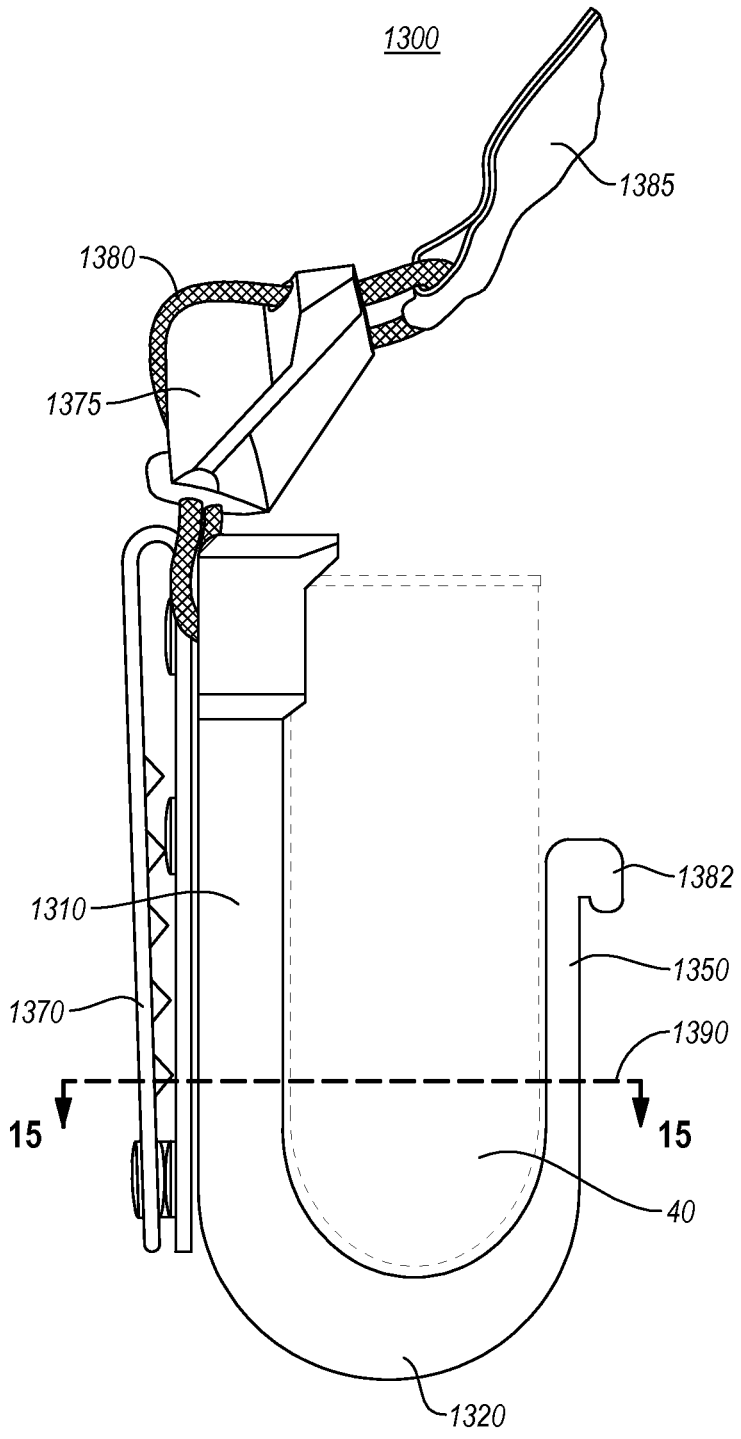
FIG. 13 illustrates a side view of an open artillery grenade holster according to one embodiment of the present invention.

Referring now to FIG. 13, depicted is a side view of an open artillery grenade holster 1300 with a grenade situated within the receptacle space. As depicted, bottom support 1320 is transverse with respect to back support 1310. Further, holster 1300 is depicted as having a holster fastening structure 1370. In one embodiment, holster fastening structure 1370 may be a bracket forming an enclosed loop or open slot configured to receive a belt, strap, or similar structure as defined previously. In other embodiments, the holster fastening structure 1370 may include a clasp, clip, buckle, hook or other fastening means. As shown, the holster fastening structure 1370 may also include one or more teeth, grooves, ribs, or other frictional surface elements to aid in retention of a strap or belt positioned within the holster fastening structure 1370.

Also depicted in FIG. 13, bottom support 1310 includes an arcuate surface, both interior and exterior, configured to receive the nose (e.g., the forward end) of grenade 40. In some embodiments, the receptacle space configured for grenade 40 may not demonstrate a structural preference for the disposition of grenade 40 within the holster 1300. As a non-limiting example, the receptacle space may be rounded and/or arcuate on opposing longitudinal ends such that the grenade 40 may be positioned without regard to orientation. In this exemplary embodiment, the bottom surface 1320 and the securing cap 1375 include arcuate surfaces. Alternatively, the opposing longitudinal ends of the receptacle space may be flat and may not preferentially receive a particular end of grenade 40. In some embodiments, the exterior surface of the bottom support may lack an arcuate surface while the interior surface maintains an arcuate surface.

Figure 14:
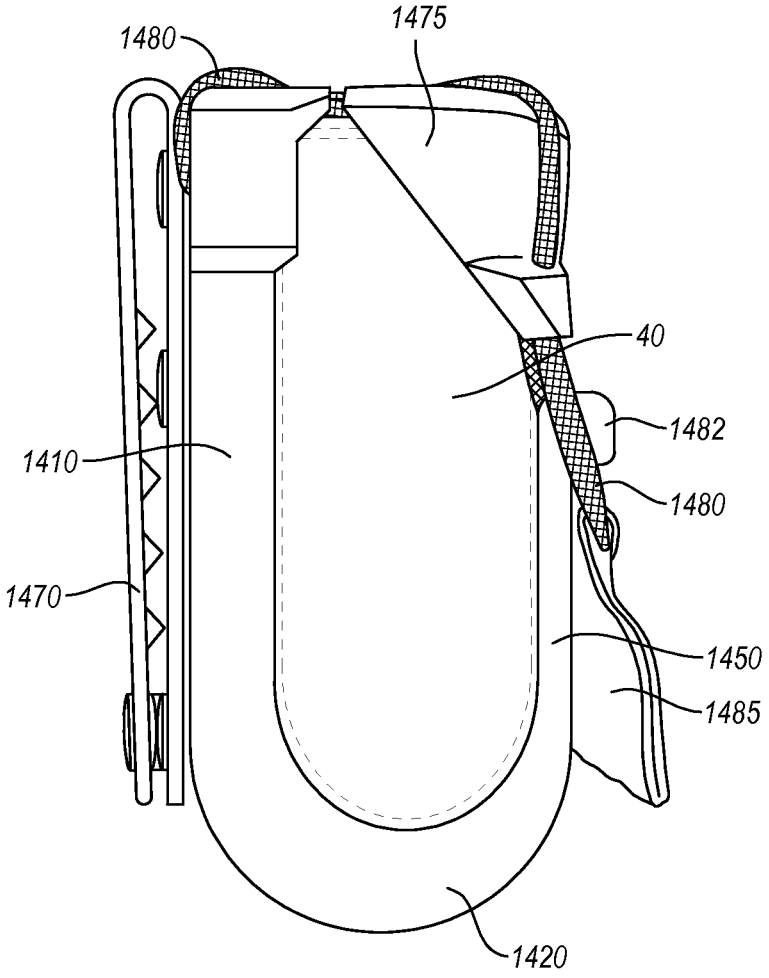
FIG. 14 illustrates a side view of a closed artillery grenade holster according to one embodiment of the present invention.

Referring now to FIG. 14, depicted is a side view of a closed artillery grenade holster 1400 according to an embodiment of the present disclosure. As shown, the receptacle space defined by back support 1410, bottom support 1420, and front support 1450 is configured to receive and, as depicted, does receive an artillery grenade 40. The securing cap 1475 engages the grenade 40 while it is within the receptacle space to secure the grenade 40 within the holster 1400. In some embodiments, and as depicted in FIG. 14, the securing cap includes and/or is associated with retention cables 1480 that are fixedly attached to the upper back end of back support 1410 and releasably attached to securing cap attachment element 1482 disposed at or near the upper front end of front support 1450.

In one embodiment, the securing cap 1475 may be releasably attached to the securing cap attachment element 1482, the securing cap 1475 communicating with at least a portion of the grenade 40 to secure it within the given receptacle space of holster 1400. The securing cap 1475 (in a closed configuration) may be removed from grenade 40 in one embodiment by applying an initial force to retention cables 1480 away from securing cap attachment element 1482. In one embodiment, this force may be applied through securing cap manipulation element 1485 or by other means. Once released from securing cap attachment element 1482, the securing cap 1475 may be positioned in an open configuration, exposing the grenade 40 to manipulation and/or removal from holster 1400.

Figure 15:
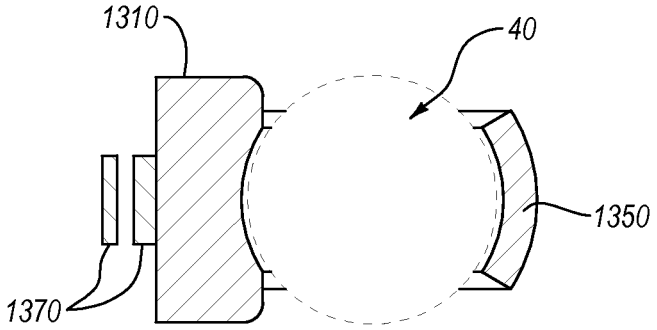
FIG. 15 illustrates a top view cutaway view of FIG. 13.

FIG. 15 illustrates a top cutaway view of the holster 1300, along line 1390 of FIG. 13. This view, in FIG. 15, illustrates the curvature formed in the back support and the back side supports sidewalls to show the curvature more clearly. As shown, the curvature defined by the back support 1310 is further defined by a radius of curvature corresponding to the circumferential radius of a grenade (e.g., a radius of about 15 mm for 30 mm grenades or a radius of about 20 mm for 40 mm grenades, etc).

The bottom support (not visible in this view) and the front support 1350 can also be configured with corresponding interior recesses or concavities formed with the same radius of curvature that is used to form the back support 1310. In one embodiment, these interior recesses or concavities may collectively define a receptacle space that is sized and shaped to receive and securely hold an artillery grenade 40.

In one embodiment, the securing cap of the present invention may be releasably attached to the holster and tension loaded as, by way of a non-limiting example, with a spring. Discharging the loaded tension removes the securing cap from the holster, exposing the holstered grenade. By way of non-limiting example, the securing cap may be re-loaded and/or the tension loading recharged and/or replaced for repeated use.

Elements described in relation to any embodiment depicted and/or described herein may be combinable with elements described in relation to any other embodiment depicted and/or described herein. For example, any element described in relation to an embodiment depicted in FIGS. 1 through 9 may be combinable with an embodiment described in relation to an embodiment depicted in FIGS. 11 through 15.

The present invention may be embodied in other specific forms without departing from its spirit or essential characteristics. The described embodiments are to be considered in all respects only as illustrative and not restrictive. In fact, any combination of the features disclosed in any of the foregoing embodiments can be combined. The invention can incorporate any combination of the different features described herein, such that components and elements from one embodiment can be incorporated into or replace elements from any of the other embodiments described herein.

What is claimed is:

1. A holster configured in size and shape for releasably retaining an artillery grenade, the holster comprising:

a back support comprising an upper end, a lower end, a first side end, a second side end a bottom support disposed proximate the lower end of the back support and extending from the back support a distance in a distal direction;

a first retaining tab disposed proximate the first side end of the back support and extending from the back support a distance in a distal direction to a first retaining tab terminal; and a second retaining tab disposed proximate the second side end of the back support and extending from the back support a distance in a distal direction to a second retaining tab terminal, the second retaining tab terminal being proximate to the first retaining tab terminal;

wherein the area between the first retaining tab, the second retaining tab, the back support, and the bottom support defines a receptacle space;

one or more rigid support members disposed within the receptacle space and associated with the back support, the one or more rigid support members having a rigidity greater than that of the back support; and an indented bottom tab disposed opposite the back support and transverse to the bottom support, the indented bottom tab extending vertically from the bottom support and configured to retain a protruding rim of the artillery grenade, wherein the indented bottom tab is additionally configured to flex outwardly to open or enlarge the receptacle space upon subjection to an outward force, thereby releasing the protruding rim of the artillery grenade disposed and held within the receptacle space, and to flex inwardly to restore the receptacle space upon discontinuation of the outward force.

2. The holster as in claim 1, further comprising a fastener structure disposed on a proximal surface of the back support, the fastener structure being configured in size and shape to attach to a wearable article.

3. The holster as in claim 1, wherein the first and second retaining tabs are configured to flex outwardly to open or enlarge the receptacle space upon subjection to an outward force, and to flex inwardly to restore the receptacle space upon discontinuation of the outward force.

4. The holster as in claim 1, wherein the holster is formed from an acrylic-polyvinyl chloride.

5. The holster as in claim 1, further comprising a selectively detachable secondary retaining element, the secondary retaining element configured to engage with the first retaining tab, the second retaining tab, or the indented bottom tab, and to prevent the first retaining tab, the second retaining tab or the indented bottom tab from flexing outward upon subjection to an outward force.

6. The holster as in claim 1, further comprising a secondary retaining element, wherein the secondary retaining element is connected to at least one retaining element connector on the first retaining tab and to at least one retaining element connector on the second retaining tab, thereby joining the first retaining tab and the second retaining tab and preventing the first retaining tab, the second retaining tab, or the indented bottom tab from flexing outward upon subjection to an outward force.

7. The holster as in claim 6, wherein the secondary retaining element is a cord, rope, or strap, or an assembly of cords, ropes, and/or straps.

8. The holster as in claim 1, wherein the one or more rigid support members comprise a chamfered edge configured to aid in securing and fitting the artillery grenade against the back support.

9. A holster configured in size and shape for releasably retaining an artillery grenade, the holster comprising:

a rigid receptacle space for receiving the artillery grenade, the receptacle space bounded by a back support and a bottom support attached to the back support, wherein a top end of the back support extends in a distal direction away from the back support forming an arch, an adjustably-sized securing cap engaging a bottom end of the artillery grenade and selectively enclosing the receptacle space to retain the artillery grenade within the receptacle space pressing the artillery grenade against the back support and the arch;

a stretchable retention cable joining the adjustably-sized securing cap to at least one of the back support or bottom support; and a securing cap manipulation element joined to the stretchable retention cable and configured as a graspable structure that enables orientation of the adjustably-sized securing cap with respect to one or more of the back support or bottom support.

10. The holster as in claim 9, further comprising a front support attached to the bottom support and positioned opposite the back support, the receptacle space being bounded by the back support, the bottom support, and the front support.

11. The holster as in claim 10, further comprising a securing cap attachment element positioned on the front support, the securing cap manipulation element configured to engage with one or more of the securing cap attachment element or the stretchable retention cable when the adjustably-sized securing cap is positioned in a closed configuration to close the receptacle space.

12. A holster configured in size and shape for releasably retaining an artillery grenade, the holster comprising:

a rigid back support comprising a back upper end, a back lower end, a first back side end, a second back side end, wherein the back upper end of the back support extends in a distal direction away from the back support forming an arch;

a rigid bottom support disposed proximate the back lower end of the back support and extending from the back support a distance in a distal direction, a rigid front support disposed proximate the bottom support and opposite the back support, the front support comprising a front upper end, a front lower end, a first front side end, and a second front side end; and an adjustably-sized securing cap positioned opposite the bottom support in a closed configuration, the adjustably-sized securing cap being moveable from an open configuration to the closed configuration in engagement with the front support;

wherein the area between the back support, the bottom support, and the front support defines a rigid receptacle space that is sized and shaped to receive and securely hold the artillery grenade; and wherein the adjustably-sized securing cap engages a bottom end of the artillery grenade and selectively encloses the receptacle space to retain the artillery grenade within the receptacle space against the back support and the arch when positioned in the closed configuration in engagement with the front support.

13. The holster as in claim 12, wherein the front support includes a securing cap attachment element positioned on the front support.

14. The holster as in claim 13, further comprising a retention cable, the retention cable fixedly attached to the back support and releasably attached to the securing cap attachment element.

15. The holster as in claim 14, wherein the retention cable is formed from a flexible material.

16. The holster as in claim 12, wherein the holster further comprises a vent positioned at the front lower end of the front support.

17. The holster as in claim 12, wherein the securing cap is tension loaded and releasably attached to the holster.

18. The holster as in claim 12, wherein the bottom support has an arcuate surface for receiving a nose portion of a grenade, and wherein the securing cap has a size and shape for fitting against a base portion of the grenade.

* * * * *